United States Patent [19]

Forbes, deceased et al.

[11] Patent Number: 4,465,036

[45] Date of Patent: Aug. 14, 1984

[54] INTERNAL COMBUSTION ENGINE

[76] Inventors: Edward K. Forbes, deceased, late of Lake Jackson, Tex.; Ivah T. Forbes, executor, 460 Hwy. 332, #135, Lake Jackson, Tex. 77566

[21] Appl. No.: 407,337

[22] Filed: Aug. 12, 1982

[51] Int. Cl.[3] ..... F02B 59/00

[52] U.S. Cl. ..... 123/57 R; 123/193 P; 123/57 A

[58] Field of Search ..... 123/193 P, 57 R, 57 A, 123/57 B, 50 R

[56] References Cited

U.S. PATENT DOCUMENTS

| | | | |
|---|---|---|---|
| 681,705 | 9/1901 | Jamieson | 123/51 AC |
| 694,552 | 3/1902 | Junkers | 123/51 B |
| 751,997 | 2/1904 | Prescott | 123/57 A |
| 926,651 | 6/1909 | Greer | 123/53 B |
| 1,126,332 | 1/1915 | Abbott | 123/50 R |
| 1,367,797 | 2/1921 | Cage | 123/57 A |
| 1,373,337 | 3/1921 | Kronenberg | 123/41.35 |
| 1,377,581 | 5/1921 | Hilton | 123/51 AC |
| 1,415,096 | 5/1922 | Kallwitz | 123/57 A |
| 1,491,410 | 4/1924 | McCallum | 123/41.74 |
| 1,897,897 | 2/1933 | Fritz | 123/57 A |
| 1,925,754 | 9/1933 | Hagan | 123/50 A |
| 2,213,816 | 9/1940 | Kinslow | 123/50 R |

*Primary Examiner*—Craig R. Feinberg
*Assistant Examiner*—David A. Okonsky
*Attorney, Agent, or Firm*—Gunn, Lee & Jackson

[57] ABSTRACT

A multi-cylinder internal combustion engine is disclosed including a crank shaft housing and a crank shaft connected to a plurality of pistons which reciprocate within the cylinders. The cylinder housing is vertically mounted to the crank shaft housing. A plurality of concentric sleeves are arranged within the cylinder housing and enclose a plurality of pistons and cylinders arranged in tandem. The concentric sleeves are connected to a selected number of cylinders and to the crank shaft for rotating the crank shaft responsive to reciprocal movement of the pistons and cylinders.

3 Claims, 3 Drawing Figures

INTERNAL COMBUSTION ENGINE

BACKGROUND OF THE DISCLOSURE

This invention relates to an engine of the reciprocating type, and particularly to an internal combustion engine wherein the pistons and cylinders are arranged in tandem.

At the present time, internal combustion engines employ a plurality of cylinders and pistons to drive the engine. The pistons are connected to a crank shaft by connecting rods. The reciprocating movement of the pistons is transformed to a rotary motion of the crank shaft in a well known manner. After each power stroke of the piston, the crank shaft carries the piston until the next power stroke. The internal combustion engine most widely used today employs a four stroke cycle including a power stroke, exhaust, intake, and compression. During the exhaust, intake and compression interval of the cycle, the piston does not apply a force to the crank shaft, but instead is carried thereby.

The present invention provides a novel construction whereby the pistons and cylinders are arranged in tandem within a plurality of concentric sliding sleeves which are connected to the crank shaft. One or more piston-cylinder pairs is connected to each sliding sleeve in a manner that reduces the interval wherein a piston is being carried by the crank shaft after the power stroke.

SUMMARY OF THE INVENTION

The present invention is an internal combustion engine employing a plurality of pistons and cylinders arranged in tandem. The pistons and cylinders are connected to a crank shaft via a plurality of concentric sliding sleeves which surround the cylinders. The tandem arrangement may be used with three, six, nine or twelve cylinders. Three concentric sleeves are provided. At least one cylinder is connected to each concentric sleeve via connecting studs which extend through a plurality of holes incorporated in the sleeves for this purpose. The holes are of sufficient size to accommodate reciprocating motion of the sleeves.

DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Figure 1:
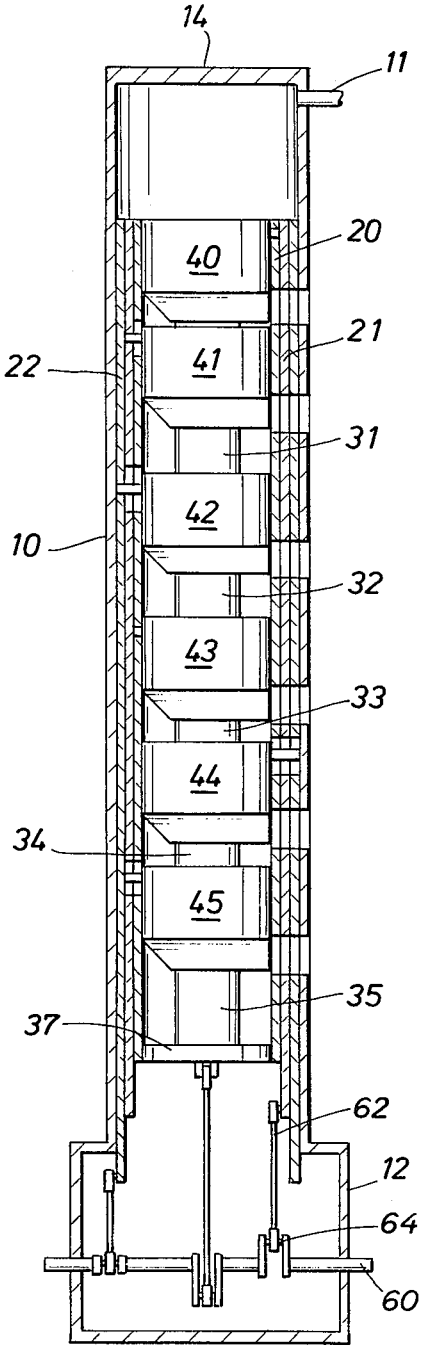
FIG. 1 is a sectional view of an embodiment of the invention showing a six cylinder and piston arrangement.

Turning first to FIG. 1, the preferred embodiment of the invention is shown. The reference numeral 10 generally designates the housing for the cylinders and pistons. The housing 10 is mounted on the crank shaft housing 12 as shown and closed at its opposite end by the end wall 14. The housing 10 has a cylindrical shape and appears much longer than the customary engine cylinder. Within the housing 10 are a number of pistons and cylinders selectively secured to a plurality of sliding sleeves which are concentrically arranged about the cylinders and pistons. Six cylinders and pistons are shown in FIG. 1 for illustrative purposes only. It is understood that a greater or fewer number of cylinders and pistons may be employed by the present invention.

Referring now specifically to FIG. 1, it is seen that three concentric sleeves 20, 21 and 22 are housed within the housing 10. The sleeve 22 is the outer sleeve which has an external diameter slightly smaller than the internal diameter of the housing 10. Sufficient space is provided for the sleeve 22 to reciprocate freely within the housing 10, however, the sleeve 22 is not permitted to wobble within the housing. The middle sleeve 21 is sized to be received within the outer sleeve 22 and, likewise, the inner sleeve 20 is sized to be received within the middle sleeve 21.

Figure 2:
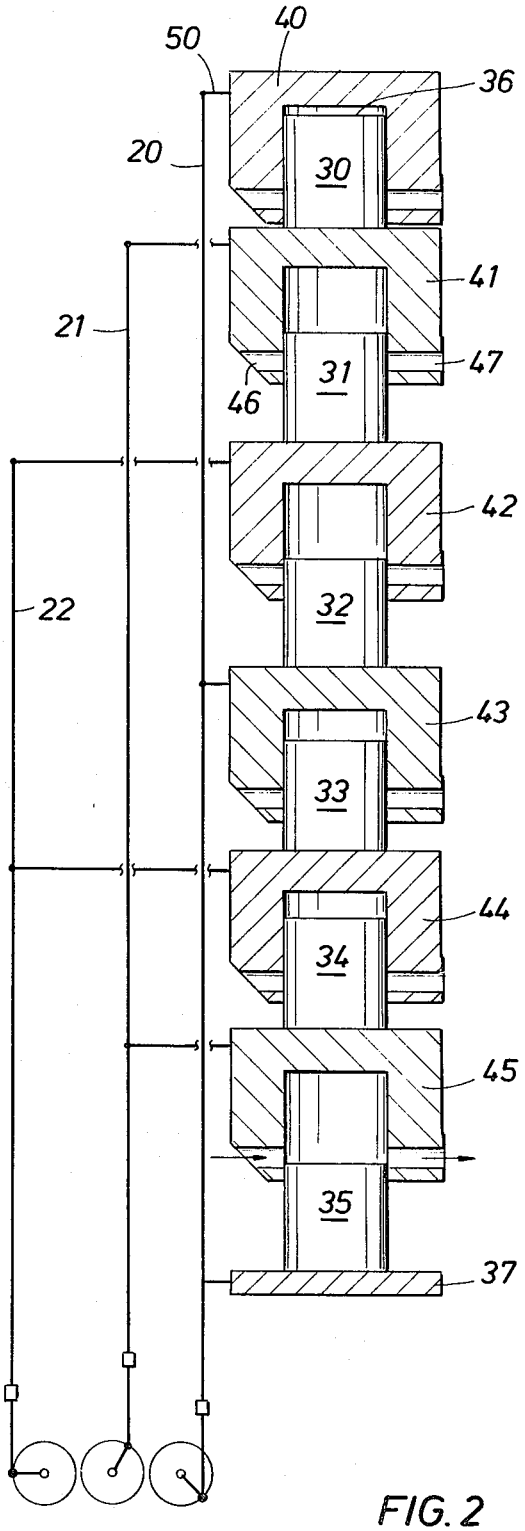
FIG. 2 is a schematic view illustrating the position of the piston during the compression stroke of one of the pistons.

As best shown in the preferred embodiment of FIG. 2, the present invention is provided with six pistons 30, 31, 32, 33, 34, and 35, and six cylinders 40, 41, 42, 43, 44, and 45. Each piston is adapted to reciprocate within a specific cylinder. Piston 35 is securely connected to a plate 37 as shown in FIG. 1. The remaining five pistons are integrally formed with an associated cylinder. For example, piston 30 includes a piston head 36 at one end thereof and the cylinder 41 extending from the opposite end. Thus, piston-cylinder combinations 30-41, 31-42, 32-43, 33-44, and 34-45 are shown in FIG. 1. Each piston-cylinder pair may be an integral piece or the pistons and cylinders may be fabricated separately and subsequently connected to form the piston-cylinder combination. The cylinder 40 is the cap or top of the stack and is not directly connected to a piston. The cylinder 40 is connected to the sleeve 20 via the studs 50 and is adapted to receive the piston 30 and provides a chamber for compressing the ignition fuel. Piston 35 is affixed to the plate 37 which, in turn, is connected to the sleeve 20 via the connecting studs 50.

Each cylinder is provided with an air/fuel inlet port 46 and exhaust outlet 47 at opposite sides of the cylinder in the usual and customary manner. The valves and inlet and exhaust ports are of a well known construction, and may be of the poppet or slide type. The necessary valve seats (not shown) are provided in the cylinder walls and are actuated by well known means (not shown). Valve lifters, where employed, include springs for resetting the valves. The pistons are provided with the usual piston rings (not shown).

Figure 3:
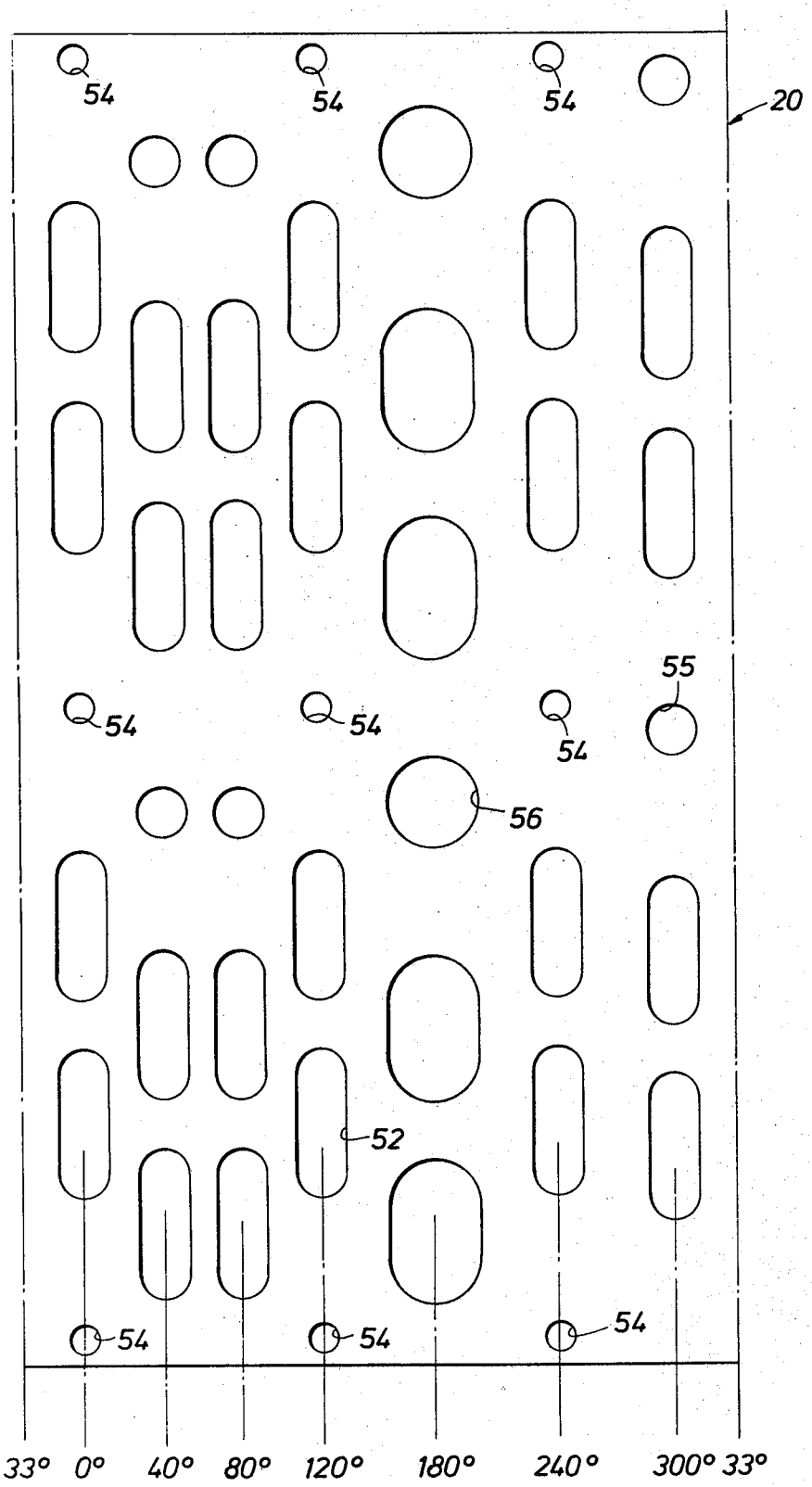
FIG. 3 is a plan view of the perforated sleeve of the invention which has been unfolded to more clearly show the perforations.

Turning now to FIG. 3, the sliding sleeve 20 is shown. The sleeve 20 is cylindrical shaped as shown in FIG. 1, however, in FIG. 3 it is shown in plan view for the sake of clarity to show the plurality of holes incorporated in the sleeve. It will be observed in FIG. 2, that the cylinders are connected to one of the sleeves via a connecting stud 50. Each cylinder is connected to one sleeve. Cylinder 40, for example, is connected to sleeve 20 and cylinder 44 is connected to sleeve 22. To accommodate direct attachment, the sleeves incorporate a plurality of holes or perforations permitting the connecting studs 50 to extend therethrough. The holes 55 and 56 provide a means for connecting the fuel inlet ports to a fuel supply and a means of escape for the exhaust after each piston has been fired. The connection points for the studs 50 are shown on the sleeve 20 at 54. It will be observed that three stud connections are spaced 120° apart. Each cylinder is connected at three points about the sleeve via the studs 50. The elongate holes 52 are sized to receive the connecting studs 50 therethrough and have sufficient length to accommodate the reciprocating motion of the slide sleeves.

Returning again to FIG. 2, it will be observed that at least two cylinders are connected to each sliding sleeve. Cylinders 40, 43 and plate 37 are connected to sleeve 20. Cylinders 41 and 45 are connected to sleeve 21, and cylinders 42 and 44 are connected to sleeve 22. Thus, in a six cylinder, two stroke cycle engine, six power pulses are applied to the crank shaft for every revolution thereof.

The pistons are connected to the crank shaft 60 via the sleeves 20, 21 and 22. Each sleeve is connected to the crank shaft 60 by means of rods 62 which are connected with cranks 64 upon the crank shaft 60. The cranks or throws 64 are arranged on the crank shaft 120° apart. The sleeves 20, 21 and 22 are connected respectively to the three throws of the crank shaft as shown in FIG. 1. The crank shaft 60 has a well known design and is connected to the drive train of the vehicle in the usual manner.

In operation, the firing order of the pistons is 30, 33, 31, 35, 32 and 34. When the head of the piston 30 reaches top dead center in cylinder 40, the gases are ignited forcing the piston 30 downwardly as related to the cylinder 40 thus applying a rotative force to the crank shaft 60 in a clockwise direction as shown in FIG. 2. The rotation of the crank shaft 60 forces the sleeve 22 upwardly, which in turn moves the piston 33 to top dead center in the cylinder 43. Top dead center being defined as the point where the gap between a piston and cylinder immediately prior to firing is the smallest. The process is repeated for sequential firing of all the pistons.

The embodiment shown in FIG. 2 is a six cylinder, two stroke cycle engine. Two pistons are connected to each sliding sleeve in such a manner to enable six power pulses or strokes to be applied to the crank shaft per revolution. The power pulses are spaced approximately sixty degrees apart permitting each piston to fire once per each revolution of the crank shaft.

Each cylinder is provided with a fuel inlet which may typically be a fuel injection nozzle. Air intake and exhaust ports are also provided. It will be observed that the air intake and exhaust ports are located at the lower end of each cylinder as shown in FIG. 2. For the two stroke engine, compressed air is supplied to the housing 10, through an inlet 11, to provide a source of air for each cylinder. Air intake and exhaust is accomplished in a well known manner and is illustrated by piston 35 and cylinder 45. After firing, the piston 35 is forced outwardly from the cylinder 45 exposing the air intake and exhaust valves. The compressed air within the housing 10, being at a higher pressure, forces the exhaust gases out of the cylinder as shown by the arrows in FIG. 2.

While the foregoing is directed to the preferred embodiment of the present invention, other and further embodiments of the invention may be devised without departing from the basic concept thereof, and the scope thereof is determined by the claims which follow.

What is claimed is:

1. A multicylinder internal combustion engine including a crank shaft located within a crank housing, the improvement comprising:

(a) a cylinder housing mounted on the crank shaft housing and extending vertically upwardly therefrom;

(b) a plurality of concentric sleeves arranged within said cylinder housing and enclosing a plurality of pistons and cylinders arranged vertically in tandem within said concentric sleeves;

(c) said pistons and cylinders are arranged in axially spaced piston - cylinder pairs, each of said pairs being connected to one of said sleeves by connecting studs;

(d) rod means connecting said concentric sleeves to the crank shaft for rotating the crank shaft responsive to reciprocal movement of said concentric sleeves;

(e) valve means communicating with said cylinders permitting intake and exhaust of gases from said cylinders; and (f) timing means causing said valve means to open and close with a cycle of the engine.

2. The apparatus of claim 1 wherein said sleeves include a plurality of perforations permitting said connecting studs to extend therethrough, said perforations being of sufficient size to allow for reciprocal movement of said sleeves.

3. The apparatus of claim 1 wherein said valve means comprises fuel inlet and exhaust ports located in each of said cylinders cooperating with fuel inlet and exhaust ports in said concentric sleeves permitting fuel to enter and exit each of said cylinders in a timed sequence.

* * * * *